US009051844B2

(12) United States Patent
Schall

(10) Patent No.: US 9,051,844 B2
(45) Date of Patent: Jun. 9, 2015

(54) HEAT RESISTANT SUPER ALLOY AND ITS USE

(75) Inventor: Gerald Schall, Bobenheim-Roxheim (DE)

(73) Assignee: BorgWarner Inc., Auburn Hills, MI (US)

( * ) Notice: Subject to any disclaimer, the term of this patent is extended or adjusted under 35 U.S.C. 154(b) by 1845 days.

(21) Appl. No.: 12/105,024

(22) Filed: Apr. 17, 2008

(65) Prior Publication Data

US 2008/0271822 A1 Nov. 6, 2008

Related U.S. Application Data

(62) Division of application No. 10/995,993, filed on Nov. 22, 2004, now abandoned.

(30) Foreign Application Priority Data

Nov. 20, 2003 (EP) ..... 03026683

(51) Int. Cl.
*F01D 5/28* (2006.01)
*C22C 19/05* (2006.01)

(52) U.S. Cl.
CPC ..... *F01D 5/28* (2013.01); *C22C 19/057* (2013.01); *F05C 2203/00* (2013.01); *F05D 2300/10* (2013.01)

(58) Field of Classification Search
USPC ..... 148/522
IPC ..... C22F 1/10; C22C 19/03,19/057
See application file for complete search history.

(56) References Cited

U.S. PATENT DOCUMENTS 3,888,663 A 6/1975 Reichman
4,078,951 A * 3/1978 Denzine et al. ..... 148/428
4,907,947 A * 3/1990 Hoppin, III ..... 416/241 R

FOREIGN PATENT DOCUMENTS

JP 11131162 A 5/1999
JP 2002294374 A * 10/2002

* cited by examiner

*Primary Examiner* — Weiping Zhu
(74) *Attorney, Agent, or Firm* — A. Michael Tucker; Stephan A Pendorf; Patent Central LLC

(57) ABSTRACT

A heat resistant super alloy suffices the following conditions:

| | | |
|---|---|---|
| carbon | 0.01-0.2 | percent in weight |
| chromium | 8-10 | percent in weight |
| aluminum | 4-6 | percent in weight |
| titanium | 2-4 | percent in weight |
| molybdenum | 1.5-2.8 | percent in weight |
| tungsten | 10-13.5 | percent in weight |
| niobium | 1.5-2.5 | percent in weight |
| boron | $0 < B \leq 0.04$ | percent in weight |
| zircon | $0 < Zr \leq 0.15$ | percent in weight |

the contents of hafnium and lanthanum together amounts to $0 < Hf + La \leq 1.5$ percent in weight,
optionally traces of tantalum,
the remainder being nickel.

Such an alloy is preferably used for turbine wheels and particularly for turbochargers.

19 Claims, 2 Drawing Sheets

HEAT RESISTANT SUPER ALLOY AND ITS USE

CROSS-REFERENCE TO RELATED APPLICATIONS

This application is a divisional application of pending U.S. patent application Ser. No. 10/995,993, filed Nov. 22, 2004, which claims priority to EP Application No. 03026683.7, filed Nov. 20, 2003, the disclosures of which are both hereby incorporated by reference.

FIELD OF THE INVENTION

The present invention relates to a heat resistant super alloy, particularly on a nickel basis. Such alloys are used in turbines for a variety of components, but also for other parts, for example for components of furnaces or appliances to be installed in furnaces and kilns. The invention relates also to a special use of this super alloy.

BACKGROUND OF THE INVENTION

As mentioned above, a variety of alloys is known for similar purposes, as may be seen from U.S. Pat. No. 3,466,171; 4,236,921 or 5,439,640. The alloy MAR 247 LC on the market is also known and is particularly used in turbine wheels for achieving higher vibration strength. It consists of eleven elements, among them a large amount of cobalt, but also relative large proportions of tantalum and hafnium. This renders this alloy relative unfavorable as to costs.

In the field of use mentioned above, it will generally be a high corrosion resistance with respect to hot gases, a high service life (long-time rupture strength, but also the creep rupture strength which play an important role for the service value. In the case of turbine wheels, and particularly in the case of high-speed turbines of turbochargers, the vibration strength will add, because the wheels are subjected to high vibration stress at varying temperatures.

SUMMARY OF THE INVENTION

It is an object of the invention to provide an alloy having improved vibration stress properties and, if possible, can be made at reduced costs.

According to the invention, this object is achieved in that the alloy suffices the following conditions:

| | | |
|---|---|---|
| carbon | 0.01-0.2 | percent in weight |
| chromium | 8-10 | percent in weight |
| aluminum | 4-6 | percent in weight |
| titanium | 2-4 | percent in weight |
| molybdenum | 1.5-2.8 | percent in weight |
| tungsten | 10-13.5 | percent in weight |
| niobium | 1.5-2.5 | percent in weight |
| boron | $0 < B \leq 0.04$ | percent in weight |
| zircon | $0 < Zr \leq 0.15$ | percent in weight |
| the contents of hafnium and lanthanum together amounts to $0 < Hf + La \leq 1.5$ percent in weight, optionally traces of tantalum, the remainder being nickel. | | |

Thus, this alloy does not present any cobalt at all and has only small proportions of tantalum and hafnium so that it is more cost saving than up to now. The alloy permits direction oriented solidification, is resistant against breaking open the particle size grading during casting, is adapted for a thin wall thickness and shows, as compared with the prior art, an improved microstructure of carbide, an improved stability of carbide and a relative high ductility which is also particularly important. The traces of tantalum should, in any case, be below 2 percent in weight, preferably below 1.5 percent in weight, and more particularly below 1 percent in weight.

Apart of this, it has an increased modulus of elasticity due to the relative high proportion of tungsten and molybdenum which have strong bonding properties with respect to nickel. Furthermore, the γ' solution temperature is increased and, not at last, it provides also an optimized service life as to vibration strength. These proportions of tungsten and molybdenum together amount preferably to >14 percent in weight.

In this alloy, forming of a γ' phase Ni3 is due to the proportions of aluminum and titanium which preferably amount together to a proportion of >7 percent in weight. The proportion of aluminum serves a double purpose, i.e. for forming the γ' phase of nickel, on the one hand, and for obtaining a long-time corrosion protection, because it forms a protective layer of $Al_2O_3$ at the surface that is especially effective at high temperatures, particularly of the waste gas driving the turbine of a turbocharger. The elements Ti, Nb and Al are responsible for precipitation-hardening and intermetallic bonding, the latter being particularly dense in the alloy according to the invention. These three elements together, therefore, should preferably have a greater proportion than 9.5 percent in weight. Thus, precipitation-hardening attains a higher level of nominal strength so that the matrix of material has to stand less plastic than elastic thermodynamic vibration amplitudes, thus achieving higher vibration strength.

It should be emphasized that the general microstructural effect of the small Ti-contents provided according to the invention reduces the formation of eutectic needles (dendrites) of the γ/γ' phases as well as the volume proportion in the eutectic. This, in turn, is significant for the reduction of intercrystalline failures.

Apart from the protective layer of $Al_2O_3$, the combined effect of the basic elements of the matrix with the element lanthanum contributes also to corrosion resistance. Of course, intercrystalline refining is of importance for the desired improved ductility. To this, the elements B, C, Zr, Hf and La will contribute. Just hafnium and lanthanum (which, in this case, has a multiple and synergetic function) attain micro-alloys which result in an absolute increase of ductility and the cohesion/adhesion ratio at the grain boundaries of the matrix. Therefore, is it preferred if the contents of hafnium and lanthanum together amounts to 0.7 percent in weight in maximum. Thus, in a particular case, the contents of lanthanum will amount to at least 0.0035 percent in weight, and will suitably not exceed 0.015 percent in weight, preferably 0.01 percent in weight in maximum. On the other hand, the contents of hafnium should amount at least to 0.3 percent in weight, and advantageously 0.7 percent in weight, preferably 0.6 percent in weight in maximum. These proportions will counteract to the tendency of dislocation within the matrix of material which results in a positive time delay for low-cycle fatigue and, thus, leads to a significant improvement of service life.

There are, however, still further (multiple and synergetic) mechanisms of function in the super alloy according to the invention. For example, the element hafnium is incorporated into the γ' phase of nickel in the alloy and increases, therefore, its strength. At the same time, the hot-crackiness when casting the alloy is reduced by the hafnium proportion, especially with materials having columnar dendrites (columnar grain).

The elements B and Zr improve creep resistance, long-time rupture strength and ductility (to which, thus, several elements of this alloy will contribute) by intercrystalline cohesion. Both elements prevent the formation of carbide films on the grain boundaries. These elements should, however, incorporated only in traces just enough to saturate the grain boundaries. Therefore, it is preferred, if the contents of boron is between 0.01 and 0.035 percent in weight and/or if the contents of zircon is between 0.02 and 0.08 percent in weight.

Finally, it should be pointed out that the element niobium substitutes aluminum in the γ' phase, thus increasing the γ' proportion in a desired manner. However, low-cycle fatigue is strongly influenced by fineness of the γ' phase, and it is the element niobium which counteracts very effectively to coarsening of the γ' phase. In addition, this element, in the matrix according to the invention, plays also the role of a mixed crystal former.

In total, it has been found that the alloy according to the invention, in an environment of up to 900° C., is free of any formation of a sigma phase. This fact, in conjunction with the improved low-cycle fatigue, makes the alloy according to the invention especially adapted for the use for turbine wheels, particularly in turbochargers.

BRIEF DESCRIPTION OF THE DRAWINGS

Further details of the invention shall be discussed with reference to the drawings in which:

FIG. 1 is a micro-section of an alloy according to the invention of which

DETAILED DESCRIPTION OF THE DRAWINGS

Figure 1:
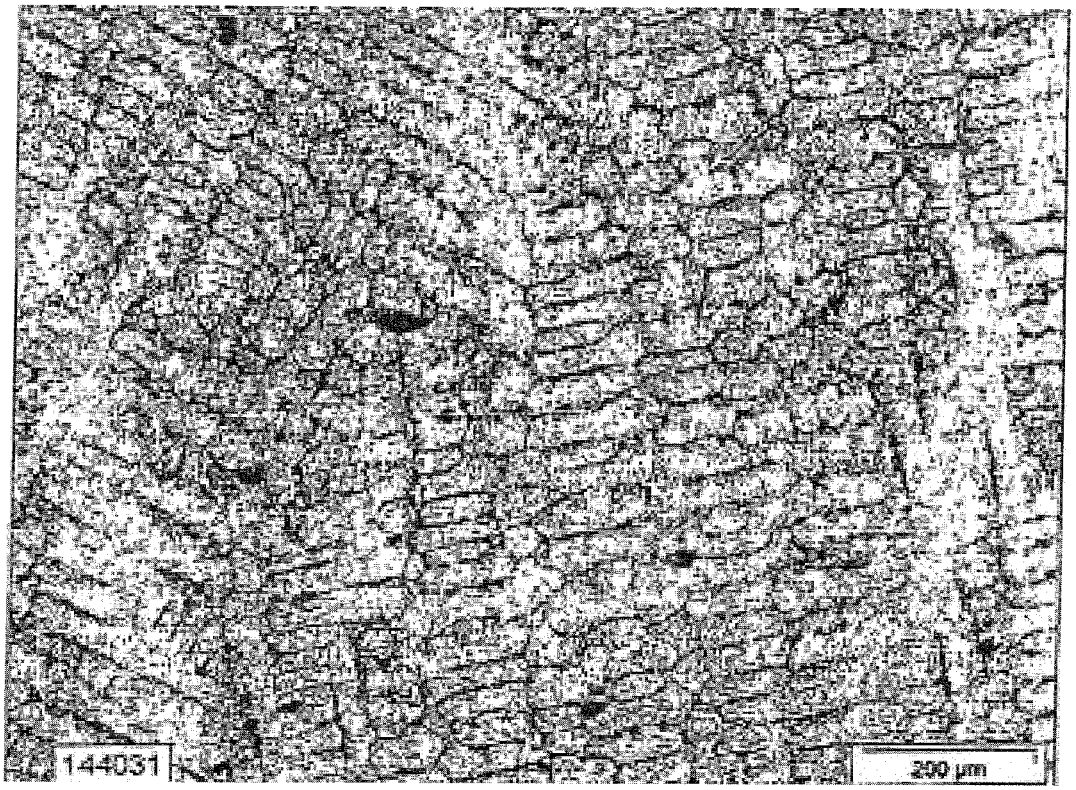

In FIG. 1, a micro-section of an alloy according to example 1, discussed later in detail, may be seen. The surface of the alloy, which comprises the layer of $Al_2O_3$ protecting against corrosion, is not visible in this figure. However, it shows clearly the γ' phase of dense, approximately elongated hexagonal crystallites with a surprising low extend of dislocation and with a direction oriented solidification which provides for extremely high strength and low-cycle fatigue. Thus, it is stable against breaking open the grain boundaries when casting, and it is adapted for producing a thin wall thickness, as is required particularly for the rotor blades of turbine rotors, particularly of a turbine, that is subjected to high temperatures, such as in a turbocharger. Eutectic needles (dendrites) of the γ/γ' phase cannot be observed in this figure.

Figure 2:
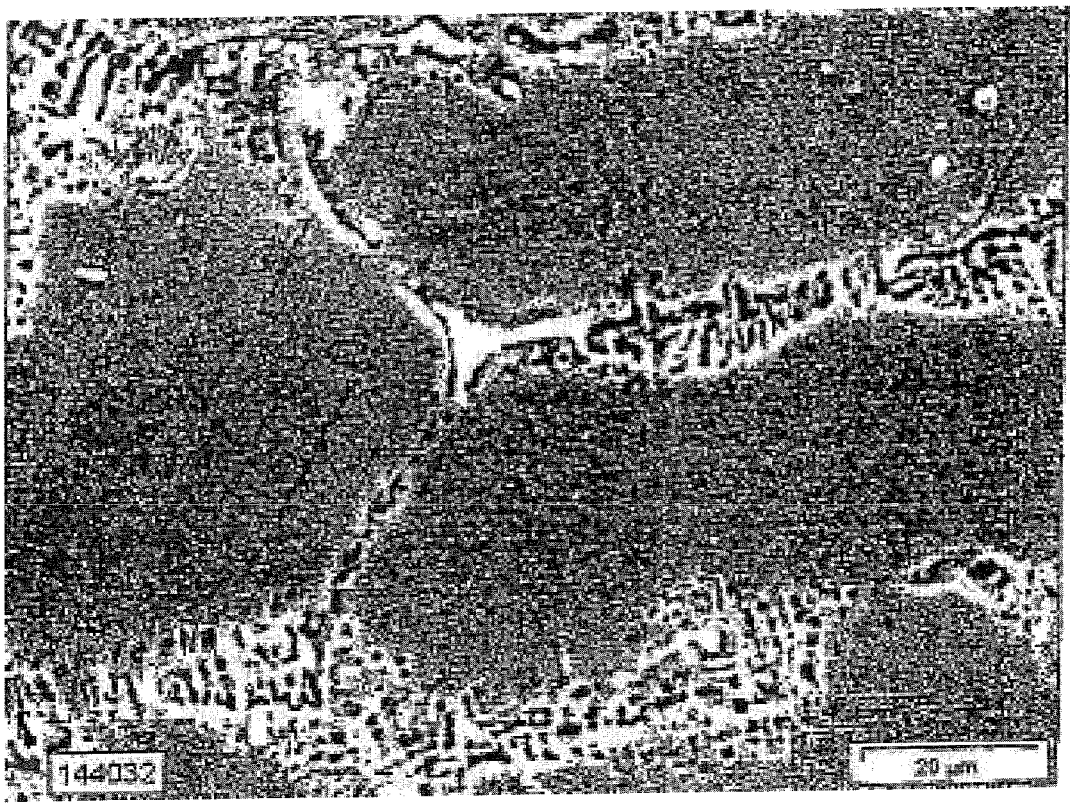
FIG. 2 illustrates a detail at an enlarged scale for clarifying the grain boundaries.

The grain boundaries show margins, which can better be seen in FIG. 2 (10-fold magnification), of a layer just of pre-dominantly titanium, tantalum, hafnium and lanthanum, that the grain surface is just covered, as may be seen. This has two important advantages, because on the one hand, the proportion of the last-named, expensive elements may be very small, while on the other hand, as has already been mentioned, the elements hafnium and lanthanum cause an absolute increase in ductility and of the cohesion/adhesion ratio at the grain boundaries of the matrix, where they, optionally together with the proportion of molybdenum, act like a "lubricant" of the grain boundaries which permits good ductility, but in the end contributes also to less fatigue. Thus, FIG. 2 clarifies why the above-mentioned elements are present in so small amounts.

The invention will be better understood with reference to the following examples.

Example 1

An alloy of the following composition (in percent in weight) has been used, the remainder being nickel:

| C | Cr | Al | Ti | Mo | W | Nb | B | Zr | Hf | La | Ta |
|---|---|---|---|---|---|---|---|---|---|---|---|
| 0.1 | 9 | 5 | 3 | 2.5 | 12.5 | 2 | 0.02 | 0.05 | 0.4 | 0.01 | 0.2 |

Thus, this resulted in a nickel proportion of 65.22 percent in weight. It should be pointed out that this alloy had, therefore, a total contents of tungsten and molybdenum of 15 percent in weight, and a total contents of aluminum and titanium of 8 percent in weight, the sum of the contents of titanium, niobium and aluminum totaling 10 percent in weight. The contents of hafnium and lanthanum totaled accordingly 0.41 percent in weight, thus being far below the maximum contents and even below the preferred maximum value of 0.7 percent in weight.

The thus formed alloy was subsequently subjected to high-temperature isostatic pressing at 1200° C. and a pressure of 1400 bar during four hours. Then, samples were made and tested in accordance with ASTM, Standard E 139. During this test, the samples were subjected to a vibration strength test at 500° C., at 750° C. and at 900° C., and at a frequency of $1 \cdot s^{-1}$ and $5 \cdot s^{-1}$, i.e. it was a series of 6 tests in total. In all tests, the improved longer service life hoped for up to breaking of the sample was attained, the performance in the domain of fatigue strength being defines as follows:

Temperature: 500° C., number of vibrations $10^3 \times 10^3$; minimum oscillation amplitude tension 305 N/mm$^2$;

Temperature: 750° C., number of vibrations $10^3 \times 10^3$; minimum oscillation amplitude tension 360 N/mm$^2$ Temperature: 900° C., number of vibrations $10^3 \times 10^3$; minimum oscillation amplitude tension 380 N/mm$^2$.

Corrosion resistance was tested in a hot gas test, and this showed a micrograph under the scanning electron microscope having a clear aluminum layer at the surface, which oxidized to $Al_2O_3$, thus providing a corrosion protective layer. This micrograph indicated clearly also the saturation of the grain boundaries by boron and zircon. Neither dendrites had been formed that are worth mentioning, nor were there columnar crystals, and there was a rather uniform grain, as may be desired (see FIG. 1).

A part of the sample was used to show that an excellent ductility and elasticity was obtained, as is particularly important with turbine blades.

Example 2

A second alloy of the following composition (in percent in weight) has been used, the remainder being nickel:

| C | Cr | Al | Ti | Mo | W | Nb | B | Zr | Hf | La |
|---|---|---|---|---|---|---|---|---|---|---|
| 0.09 | 9.5 | 5.5 | 2.5 | 2 | 13 | 1.75 | 0.025 | 0.08 | 0.45 | 0.005 |

This resulted, thus, in a proportion of nickel of 65.1 percent in weight. It should be pointed out that this alloy had, therefore, a total contents of hafnium and lanthanum of 0.455 percent in weight, a total contents of tungsten and molybdenum of 15 percent in weight, and a total contents of aluminum and titanium of 8 percent in weight, the sum of the contents of titanium, niobium and aluminum totaling 9.75 percent in weight. Thus, no tantalum had been used in this example.

Subsequently, the alloy thus formed was subjected to the same tests as in example 1 wherein the elasticity was slightly improved as compared with example 1.

Example 3

A third alloy of the following composition (in percent in weight) has been used, the remainder being nickel:

| C | Cr | Al | Ti | Mo | W | Nb | B | Zr | Hf | La | Ta |
|---|---|---|---|---|---|---|---|---|---|---|---|
| 0.12 | 8.5 | 4.5 | 3.5 | 2.75 | 11.5 | 2.3 | 0.01 | 0.03 | 0.6 | 0.004 | 0.6 |

This resulted, thus, in a proportion of nickel of 65.586 percent in weight. It should be pointed out that this alloy had, therefore, a total contents of hafnium and lanthanum of 0.604 percent in weight, a total contents of tungsten and molybdenum of 15 percent in weight, and a total contents of aluminum and titanium of 8 percent in weight, the sum of the contents of titanium, niobium and aluminum totaling 10 percent in weight.

The tests carried as in example 1 showed slightly increased ductility. When, however, a long-time test in a corrosive atmosphere (combustion gas of a gasoline engine at about 900° C.) was carried out, a slightly reduced corrosion resistance was found as compared to a similar test of the samples of examples 1 and 2.

Example 4

This example, after the previous good results with alloys of the examples 1 to 3, served mainly the purpose to be able to assess the tendency resulting from somewhat more extreme proportions of the elements. Therefore, an alloy of the following composition (in percent in weight) was used, the remainder being nickel:

| C | Cr | Al | Ti | Mo | W | Nb | B | Zr | Hf | La |
|---|---|---|---|---|---|---|---|---|---|---|
| 0.12 | 8.5 | 4.5 | 3.5 | 2.75 | 11.5 | 2.3 | 0.01 | 0.03 | 0.6 | 0.004 |

This resulted, thus, in a proportion of nickel of 67.45 percent in weight. It should be pointed out that this alloy had, therefore, a total contents of hafnium and lanthanum of 0.82 percent in weight, a total contents of tungsten and molybdenum of 12 percent in weight, and a total contents of aluminum and titanium of 8 percent in weight, the sum of the contents of titanium, niobium and aluminum totaling 9.5 percent in weight. In this example too, one had abstained from using tantalum.

It should be stated that the samples produced from this alloy did not lead to any additional improvement as compared with the results of examples 1 to 3. In spite of the somewhat higher proportion of hafnium and lanthanum, the ductility was rather lower which may, possibly, be a consequence of the higher proportion of C and Cr, but possibly also due to the lack of tantalum.

Still further examples and tests were carried out to determine the limiting proportion of the elements of the alloy, wherein the values were determined which form the subject matter of the claims and are discussed above.

From the alloys of the above examples, turbine rotors for a turbocharger were produced which were then subjected to solution annealing at 1200° C. for 8 hours, and then to precipitation hardening at 860° C. for 16 hours, each time with subsequent air cooling. All sample rotors were subjected to a long-time test and stood the tests beyond expectance.

What is claimed is:

1. A method of manufacturing a turbine wheel for a turbocharger, the method comprising:

providing a nickel-based alloy having 0.01-0.2 percent in weight of carbon, 8-10 percent in weight chromium, 4-6 percent in weight aluminum, 2-4 percent in weight titanium, 1.5-2.8 percent in weight molybdenum, 10-13.5 percent in weight tungsten, 1.5-2.5 percent in weight niobium, less than or equal to 0.04 percent in weight boron, less than or equal to 0.15 percent in weight zircon, between 0.3 to 0.6 percent in weight the hafnium, and optionally lanthanum, provided that the total hafnium and lanthanum is less than or equal to 1.5 percent in weight;

casting the nickel-based alloy to form a geometry of the turbine wheel;

performing high temperature isostatic pressing on the turbine wheel; and forming an aluminum oxide layer along a surface of the turbine wheel.

2. The method of claim 1, wherein the high temperature isostatic pressing is performed at about 1200° C.

3. The method of claim 1, further comprising performing direction oriented solidification to form elongated hexagonal crystallites in the turbine wheel.

4. The method of claim 1, further comprising solution annealing the turbine wheel and then air cooling the turbine wheel.

5. The method of claim 4, wherein the solution annealing is performed at about 1200° C.

6. The method of claim 1, further comprising precipitation hardening the turbine wheel and then air cooling the turbine wheel.

7. The method of claim 6, wherein the precipitation hardening is performed at about 860° C.

8. The method of claim 1, wherein the nickel-based alloy is substantially free of cobalt.

9. The method of claim 1, wherein the remainder of the nickel-based alloy is nickel.

10. The method of claim 1, wherein the nickel based alloy has traces of tantalum, and wherein the remainder of the nickel-based alloy is nickel.

11. The method of claim 1, wherein the boron is between 0.01 to 0.035 percent in weight.

12. The method of claim 1, wherein the zircon is between 0.02 to 0.015 percent in weight.

13. The method of claim 1, wherein the tungsten and molybdenum together is greater than or equal to 14.0 percent in weight.

14. The method of claim 1, wherein the aluminum and titanium together is greater than or equal to 7.0 percent in weight.

15. The method of claim 1, wherein the titanium, niobium and aluminum together is greater than or equal to 9.5 percent in weight, and wherein the tantalum is less than 1.0 percent in weight.

16. A method of manufacturing a turbine wheel for a turbocharger, the method comprising:

(a) providing a nickel-based alloy having:

0.01-0.2 percent in weight of carbon, 8-10 percent in weight chromium, 4-6 percent in weight aluminum, 2-4 percent in weight titanium, 1.5-2.8 percent in weight molybdenum, 10-13.5 percent in weight tungsten, 1.5-2.5 percent in weight niobium, less than or equal to 0.04 percent in weight boron, less than or equal to 0.15 percent in weight zircon, between 0.3 and 0.6 percent in weight the hafnium, and between 0.0035 and 0.01 percent in weight lanthanum, (b) casting the nickel-based alloy to form a geometry of the turbine wheel;

(c) performing high temperature isostatic pressing on the turbine wheel; and (d) forming an aluminum oxide layer along a surface of the turbine wheel.

17. A method of manufacturing a turbine wheel for a turbocharger, the method comprising:

providing a nickel-based alloy having 0.01-0.2 percent in weight of carbon, 8-10 percent in weight chromium, 4-6 percent in weight aluminum, 2-4 percent in weight titanium, 1.5-2.8 percent in weight molybdenum, 10-13.5 percent in weight tungsten, 1.5-2.5 percent in weight niobium, less than or equal to 0.04 percent in weight boron, less than or equal to 0.15 percent in weight zircon, 0.0035-0.015 percent in weight lanthanum, and optionally hafnium, wherein the combination of hafnium and lanthanum comprises less than or equal to 1.5 percent in weight, wherein the nickel-based alloy is substantially free of cobalt;

casting the nickel-based alloy to form a geometry of the turbine wheel;

performing high temperature isostatic pressing on the turbine wheel;

solution annealing the turbine wheel and then air cooling the turbine wheel;

precipitation hardening the turbine wheel and then air cooling the turbine wheel; and forming an aluminum oxide layer along a surface of the turbine wheel.

18. The method of claim 17, wherein the hafnium and lanthanum together is less than or equal to 0.7 percent in weight.

19. The method of claim 17, wherein the hafnium is between 0.3 to 0.6 percent in weight.

* * * * *